United States Patent [19]

Anzai et al.

[11] Patent Number: 4,712,522

[45] Date of Patent: Dec. 15, 1987

[54] METHOD AND APPARATUS FOR CONTROLLING AIR-FUEL RATIO IN INTERNAL COMBUSTION ENGINE

[75] Inventors: Katsushi Anzai; Osamu Harada; Toshio Suematsu; Yuji Takeda, all of Toyota, Japan

[73] Assignee: Toyota Jidosha Kabushiki Kaisha, Toyota, Japan

[21] Appl. No.: 768,830

[22] Filed: Aug. 23, 1985

[30] Foreign Application Priority Data

Aug. 27, 1984 [JP] Japan ..... 59-176695
Aug. 27, 1984 [JP] Japan ..... 59-176696
Aug. 27, 1984 [JP] Japan ..... 59-176691

[51] Int. Cl.[4] ..... F02D 41/06
[52] U.S. Cl. ..... 123/179 L; 123/491
[58] Field of Search ..... 123/179 G, 179 L, 325, 123/326, 491, 478

[56] References Cited

U.S. PATENT DOCUMENTS

| | | | |
|---|---|---|---|
| 4,245,604 | 1/1981 | Lahiff | 123/478 |
| 4,436,073 | 3/1984 | Miyagi | 123/491 |
| 4,437,445 | 3/1984 | Takahashi et al. | 123/491 |
| 4,452,212 | 6/1984 | Takase | 123/326 X |
| 4,462,375 | 7/1984 | Isobe et al. | 123/179 L X |
| 4,469,072 | 9/1984 | Kobayashi et al. | 123/491 |
| 4,526,153 | 7/1985 | Hasegawa et al. | 123/491 X |
| 4,562,819 | 1/1986 | Kobayashi et al. | 123/179 G X |
| 4,563,994 | 1/1986 | Ujihashi | 123/491 |

*Primary Examiner*—Willis R. Wolfe, Jr.
*Attorney, Agent, or Firm*—Cushman, Darby & Cushman

[57] ABSTRACT

In an internal combustion engine, warming-up fuel enrichment is carried out in accordance with the temperature of the engine coolant. This fuel enrichment is further increased in accordance with the temperature of the engine coolant at the moment when a starter is turned on.

16 Claims, 18 Drawing Figures

| |
|---|
| Fig. 6A |
| Fig. 6B |

SPD
(km/h)
40
30
20
10
0
t1
t2

Ne

LL
"1"
"0"

FWL
TIME

PRIOR ART

METHOD AND APPARATUS FOR CONTROLLING AIR-FUEL RATIO IN INTERNAL COMBUSTION ENGINE

BACKGROUND OF THE INVENTION

1. Field of the Invention

The present invention relates to a method and apparatus for controlling the air-fuel ratio in an internal combustion engine in which a fuel increment for warming up the engine is carried out in accordance with the temperature of the engine coolant.

2. Description of the Related Art

In general, fuel enrichment for engine warm-up is carried out in accordance with the temperature of the engine coolant. When an engine is started at an extremely low temperature, the temperature of the intake air does not rise as rapidly as the temperature of the engine coolant. Accordingly, the controlled air-fuel ratio tends to be on the lean side, inviting poor drivability, backfires, and the like.

SUMMARY OF THE INVENTION

It is an object of the present invention to provide a method and apparatus for controlling the air-fuel ratio in an internal combustion engine which can carry out optimum warming-up fuel enrichment even when an engine is started at an extremely low temperature.

According to the present invention, the warming-up fuel increment, calculated in accordance with the temperature of the engine coolant, is further increased in accordance with the temperature of the engine coolant at the moment when a starter is turned on. As a result, even when the engine is started at an extremely low temperature, the warming-up fuel increment can be carried out substantially in accordance with the temperature of the intake air.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
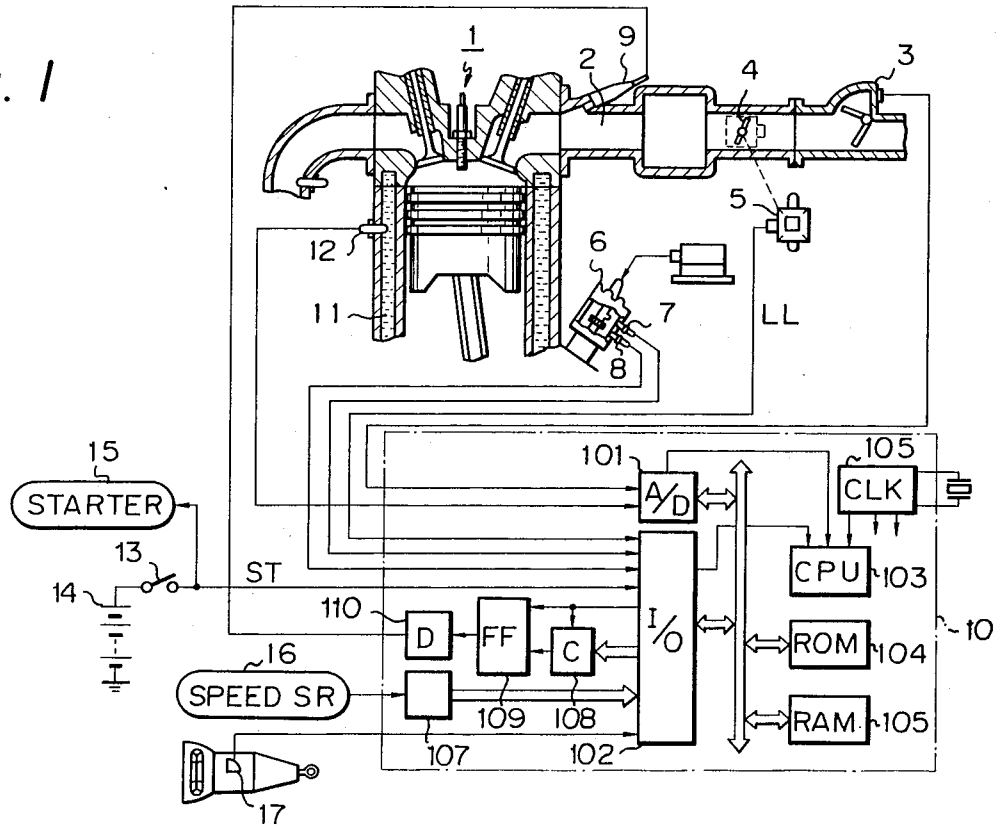
FIG. 1 is a schematic diagram of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Also provided in the air-intake passage 2 is a throttle valve 4 which has an idling position switch 5 at the shaft thereof. The idling position switch 5 detects whether or not the throttle valve 4 is completely closed, i.e., in an idling position, to generate an idle signal "LL" which is transmitted to an input/ouput (I/O) interface 102.

Disposed in a distributor 6 are crank angle sensors 7 and 8 for detecting the angle of the crankshaft (not shown) of the engine 1. In this case, the crank-angle sensor 7 generates a pulse signal at every 720° crank angle (CA) while the crank-angle sensor 8 generates a pulse signal at every 30°CA. The pulse signals of the crank angle sensors 3 and 8 are supplied to an input/output (I/O) interface 102 of the control circuit 10. In addition, the pulse signal of the crank angle sensor 8 is then supplied to an interruption terminal of a central processing unit (CPU) 103.

Additionally provided in the air-intake passage 2 is a fuel injection valve 9 for supplying pressurized fuel from the fuel system to the air-intake port of the cylinder of the engine 1. In this case, other fuel injection valves are also provided for other cylinders, though not shown in FIG. 1.

Disposed in a cylinder block 11 of the engine 1 is a coolant temperature sensor 12 for detecting the temperature of the coolant. The coolant temperature sensor 12 generates an analog voltage signal in response to the temperature of the coolant and transmits it to the A/D converter 101 of the control circuit 10.

Reference numeral 13 designates a starter switch for connecting a battery 14 to a starter 15. The output of the starter switch 13 is also supplied to the I/O interface of the control circuit 10.

Reference numeral 16 designates a vehicle speed sensor which generates a pulse signal having a frequency in proportion to the vehicle speed SPD. The pulse signal is transmitted via a vehicle speed generating circuit 107 of the control circuit 10 to the I/O interface 102 thereof.

Reference numeral 17 designates a gear-shift position switch which is turned on when the gear-shift position of the automatic transmission is at a drive position. Note that, if the vehicle includes a manual transmission, not an automatic transmission, a clutch switch is provided instead of the gear-shift position switch 17.

The control circuit 10, which may be constructed by a microcomputer, further includes a read-only memory (ROM) 104 for storing a main routine, interrupt routines such as a fuel injection routine, an ignition timing routine, tables (maps), constants, etc., a random access memory 105 (RAM) for storing temporary data, a clock generator 10 for generating various clock signals, a down counter 108, a flip-flop 109, a driver circuit 110, and the like.

The down counter 108, the flip-flop 109, and the driver circuit 110 are used for controlling the fuel injection valve 9. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107 and finally generates a logic "1" signal from the carry-out terminal thereof to reset the flip-flop 109, so that the driver circuit 110 stops the activation of the fuel injection valve 9. Thus, the amount of fuel corresponding to the fuel injection amount TAU is injected into the fuel injection valve 9.

Interruptions occur at the CPU 103, when the A/D converter 101 completes an A/D conversion and generates an interrupt signal; when the crank angle sensor 8 generates a pulse signal; and when the clock generator 106 generates a special clock signal.

The intake air amount data Q of the airflow meter 3 and the coolant temperature data THW are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30°CA, i.e., at every pulse signal of the crank angle sensor 8, and is then stored in the RAM 105.

The operation of the control circuit 10 of FIG. 3 will be explained with reference to the flow charts of FIGS. 2, 3, 5, 6, and 7.

Figure 2:
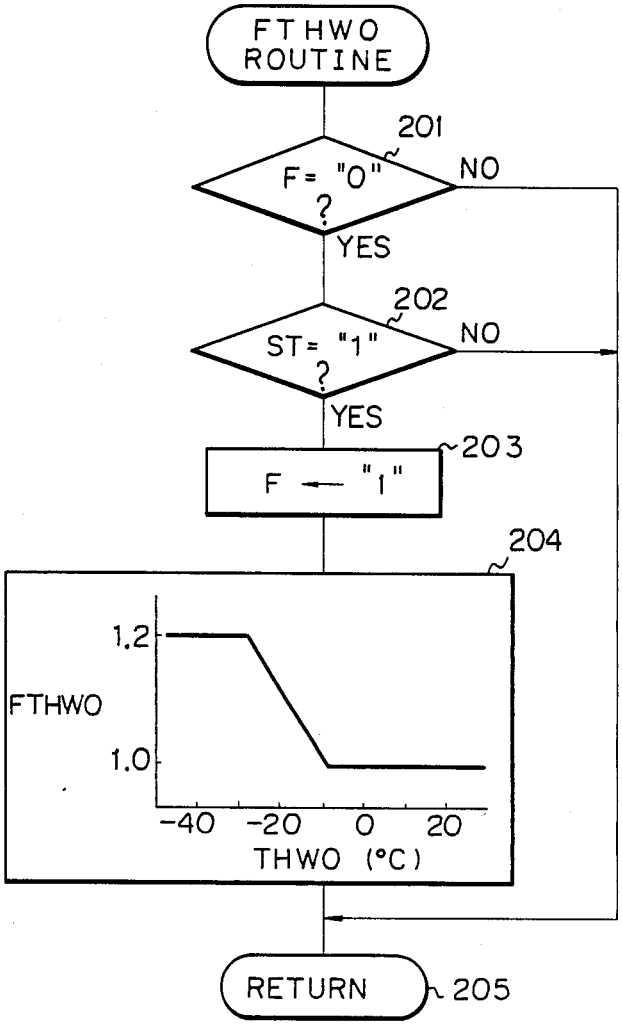
FIGS. 2, 3, 5, 6, 6A, 6B, 7A and 7B are flow charts showing the operation of the control circuit of FIG. 1.

FIG. 2 is a routine for calculating a correction amount FTHWO for a warming-up fuel increment FWL executed as one part of the main routine. The correction amount FTHWO is determined by the coolant temperature THW at the moment when the starter 16 is turned on. Note that a flag F is cleared at the initial routine (not shown).

At step 201, it is determined whether or not the flag F is "0". Only if the flag F is "0", the control proceeds to step 202. At step 202, the CPU 103 fetches the output ST of the starter switch 13 and determines whether or not the output ST is "1", i.e., the starter switch 13 is on. When ST is "1", the control proceeds to step 204 which sets the flag F, while when ST is "0", the control jumps to step 205.

That is, only when the starter switch 13 is changed from off to on, the control proceeds to step 204, and thereafter, the control jumps to step 205.

At step 204, a correction amount FTHWO is calculated from a one-dimensional map stored in the ROM 104 by using the parameter THWO as shown in the block of step 204. Note that the parameter THWO is the coolant temperature THW stored in the RAM 105.

Then, the routine of FIG. 2 is completed by step 205.

As shown in step 204, the larger the correction amount FTHWO, the lower the coolant temperature THWO at the moment when the starter switch 13 is turned on. That is, when the temperature of the intake air at the moment when the starter switch 13 is turned on is low, as explained later, the warming-up fuel increment FWL is further increased by $$FWL \leftarrow FWL \times FTHWo.$$

Figure 3:
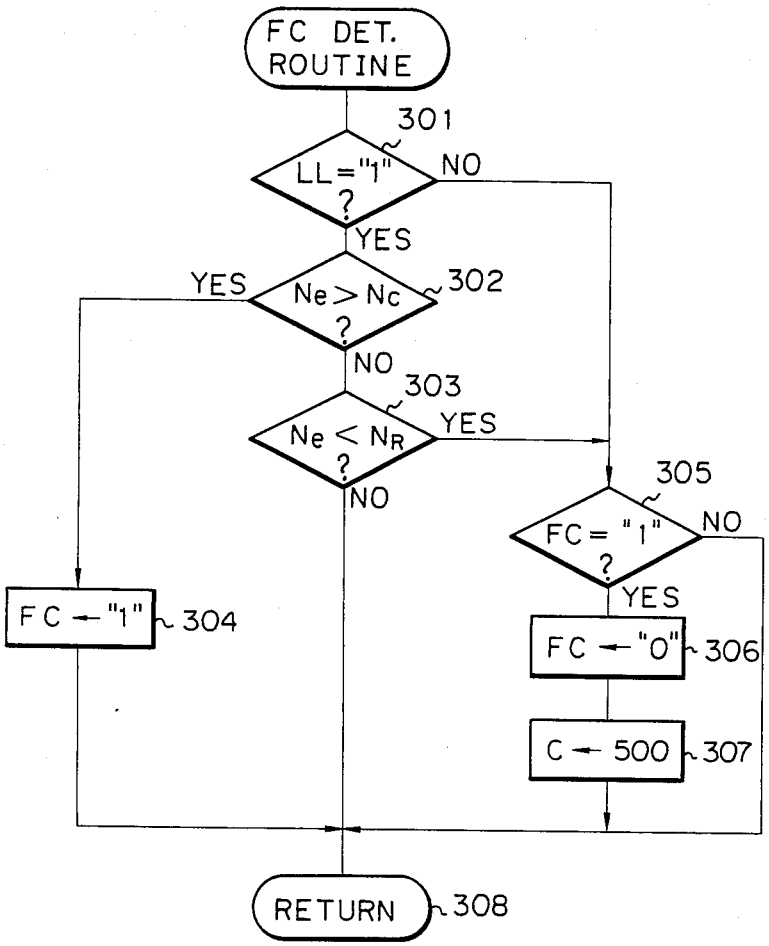
Figure 4:
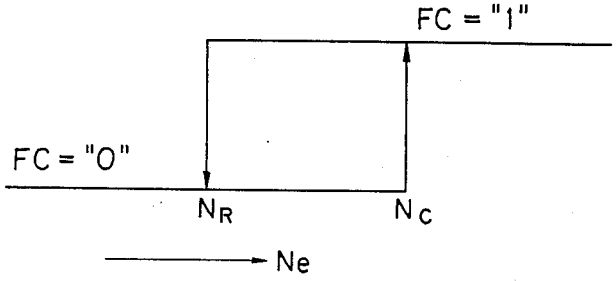
FIG. 4 is a graph showing the characteristics of the fuel cut flag FC of FIG. 3.

FIG. 3 is a routine for the determination of a fuel cut-off flag FC executed at every predetermined time period or as one part of the main routine. That is, this routine is used for the determination of a flag FC as shown in FIG. 4. In FIG. 4, $N_c$ designates a fuel cut-off engine speed, and $N_R$ designates a fuel cut-off recovery engine speed. All of the values $N_c$ and $N_R$ are dependent upon the engine coolant temperature THW.

At step 301, it is determined whether or not the output signal LL of the idling position switch 5 is "1", i.e., whether or not the engine 1 is in an idling state. If in an idling state, at step 302, the engine speed $N_e$ is read out of the RAM 105, and is compared with the fuel cut-off engine speed $N_c$, and at step 303, the engine speed $N_e$ is compared with the fuel cut-off recovery engine speed $N_R$. As a result, if $N_e > N_c$, the control proceeds to step 304, which sets the flag FC, i.e., FC←"1". If $N_e < N_R$, the control proceeds to step 305 which resets the flag FC. If $N_R \leqq N_e \leqq N_c$, the control proceeds directly to step 308, so that the flag FC is unchanged, and accordingly, remains at the previous state.

If not in an idling state at step 301, the control jumps to step 305.

At step 305, it is determined whether or not the flag FC is "1". If FC = "1", this means that a transition from a fuel cut-off state to a fuel cut-off recovery state is detected. In this case, the control proceeds to step 306, which clears the flag FC and sets an initial value such as 500 in a counter C.

If FC= "0" at step 305, the control jumps to step 308. The routine of FIG. 3 is completed by step 308.

Figure 5:
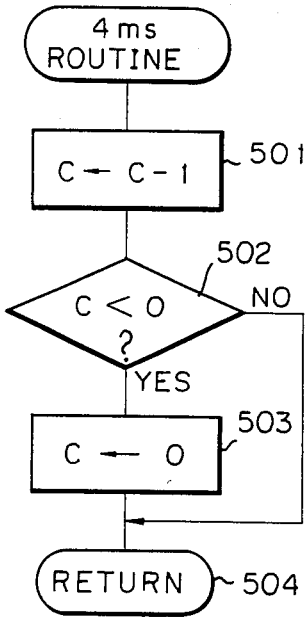

The counter C is decremented by 1 at a 4 ms timer routine as shown in FIG. 5. That is, at step 501, the coutner C is decremented by 1, and at steps 502, and 503, the counter C is guarded by a minimum value, which is, in this case, 0. Then, the routine of FIG. 5 is completed by step 504. Therefore, the counter C is used for measuring the duration period 2s (=4 ms×500) after the transition from a fuel cut-off state to a fuel cut-off recovery state.

Thus, when a transition from a fuel cut-off state to a fuel cut-off recovery state occurs, the measure of a predetermined time period such as 2s is initiated.

Figures 6, 6A:
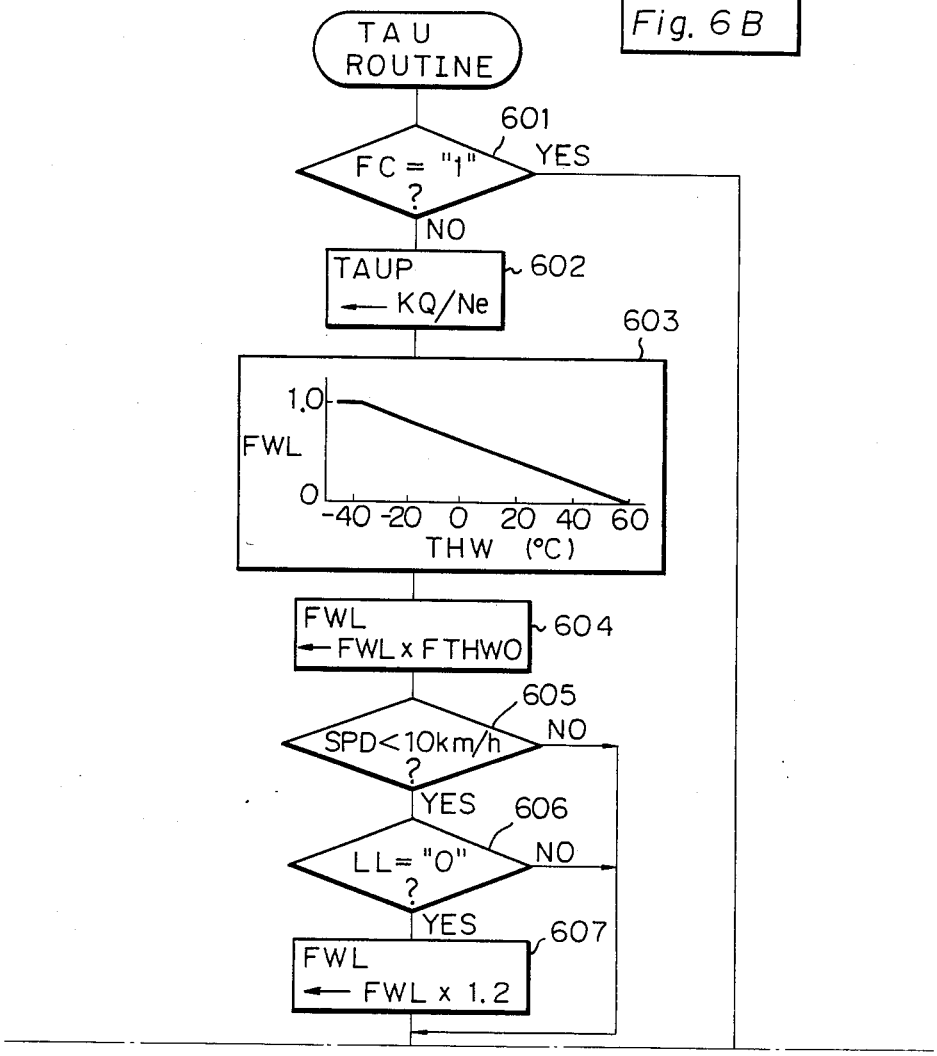
Figure 6B:
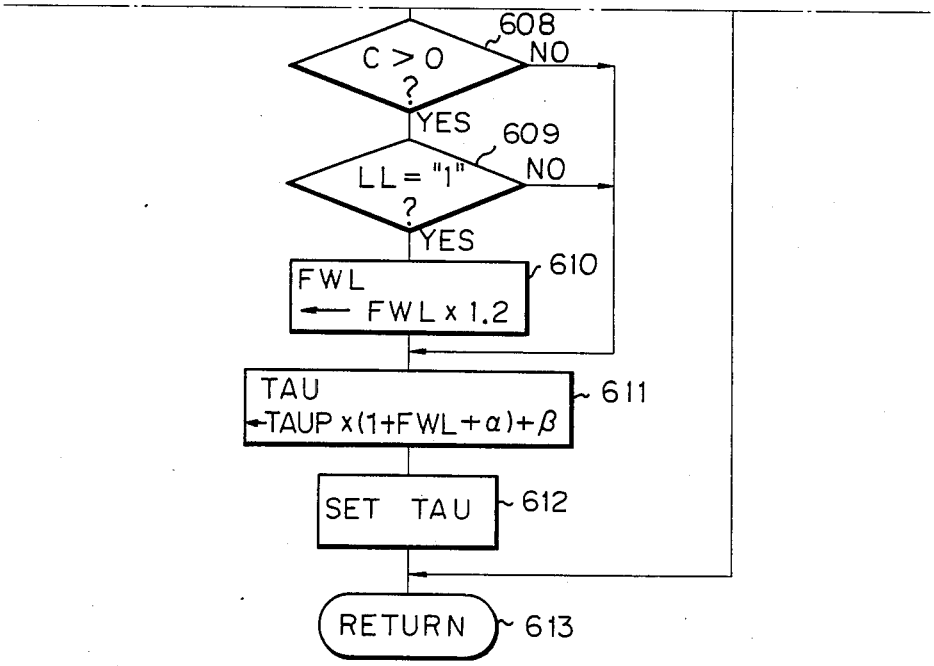

FIG. 6 is a routine for calculating a fuel injection amount TAU executed at every predetermined crank angle such as 360°CA. At step 601, it is determined whether or not the fuel cut-off flag FC is "1". If FC= "1", the control jumps to step 613, whereby no fuel injection is carried out. If FC= "0", the control proceeds to step 602.

At step 602, a base fuel injection amount TAUP is calculated by using the intake air amount data Q and the engine speed data Ne stored in the RAM 105. That is, $$TAUP \leftarrow KQ/Ne$$

where K is a constant. Then at step 603, a warming-up incremental amount FWL is calculated from one-dimensional map by using the coolant temperature data THW stored in the RAM 105. Note that the warming-up incremental amount FWL decreases when the coolant temperature increases.

At step 604, the warming-up fuel increment FWL is corrected by the correction amount FTHWO obtained in the routine of FIG. 2. That is $$FWL \leftarrow FWL \times FTHW0$$

At steps 605 and 606, an initial state where the vehicle starts to move (initial "take-off" state) is detected. That is, at step 605, the CPU 103 fetches the outputs of the vehicle speed generating circuit 107 and calculates a vehicle speed SPD. Then, the CPU 103 determines whether or not the vehicle speed SPD is smaller than a relatively small value such as 10 km/h. Also, at step 606, it is determined whether or not the output LL of the idling position switch 5 is "0". Only if SPD<10 km/h and LL= "0", does the control proceed to step 607, which increases the warming-up fuel increment FWL by FWL←FWL×1.2.

Otherwise, the control jumps to step 608.

Figure 7A:
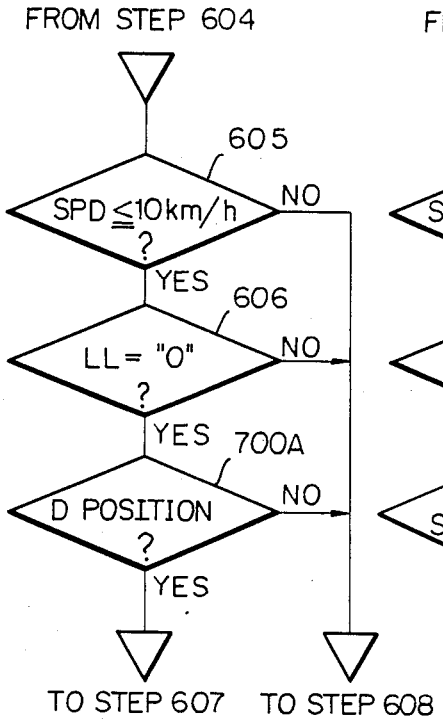
Figure 7B:
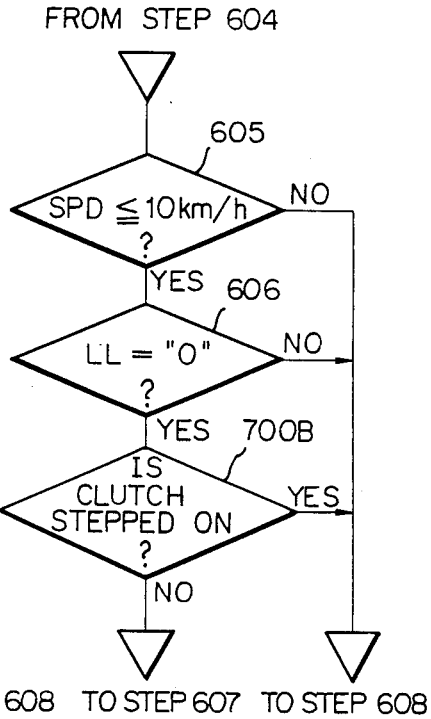
Figures 8A, 8B, 8C, 8D:
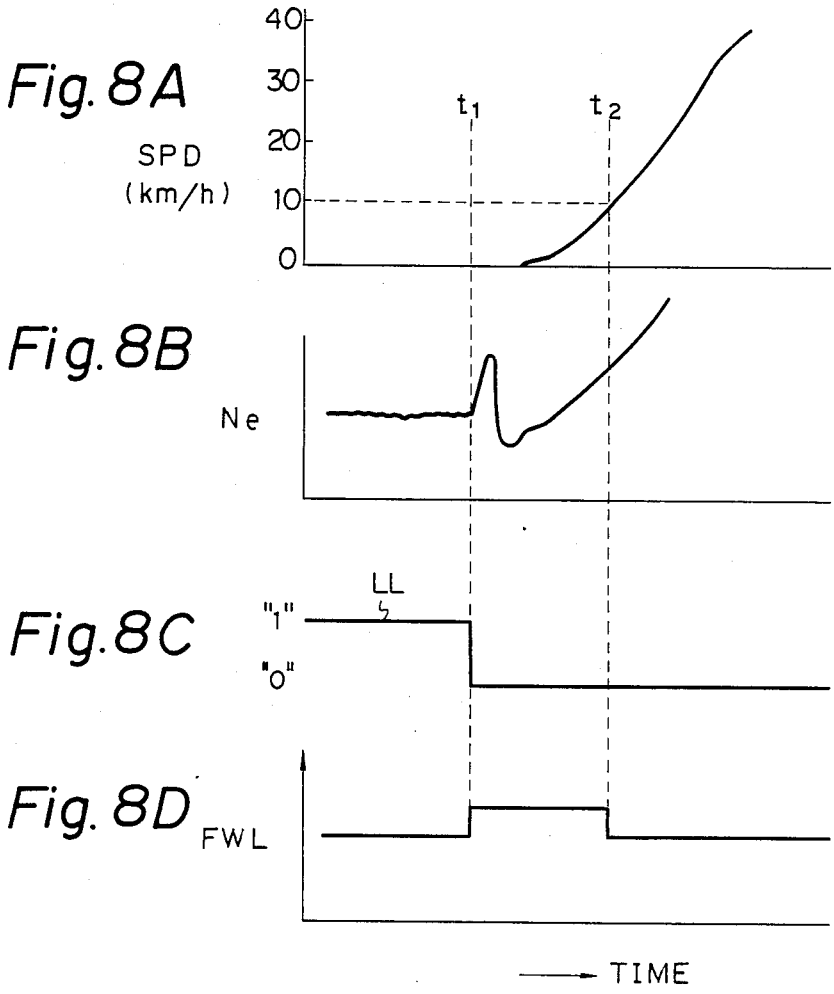
FIGS. 8A to 8D, 9A, 9B, 10A, and 10B are timing diagrams explaining the effect of the present invention.

As occasion demands, other conditions can be added to the conditions of determination of an initial take-off state, thereby more reliably detecting such an initial state. For example, in the case of an automatic transmission mounting vehicle, as shown in FIG. 7A, there is further provided a step 700A which determines whether or not the gear-shift position is at the drive (D) position by the output of the gear-shift position switch 17. If the gear-shift position is at the D position, the control proceeds to step 607, otherwise, the control jumps to step 608. Also, in the case of a manual transmission mounting vehicle, as shown in FIG. 7B, there is further provided a step 700B which determines by the clutch switch whether or not the clutch is stepped on (disengaged). If the clutch is engaged, the control proceeds to step 607. Otherwise, the control jumps to step 608.

Note that step 606 of FIG. 6 can be deleted, although, in this case, the reliability of detection of a take-off state is low.

At step 608, it is determined whether or not the counter C is larger than 0, i.e., whether, or not the predetermined time period (=2s) passes. Also, at step 609, it is determined whether or not the output LL of the idling position switch 5 is "1". Only if C>0 (the predetermined time period does not pass and LL="1" (the throttle value 4 is completely closed), the control proceeds to step 610, which increases the warming-up fuel increment FNL by $$FWL \leftarrow FWL \times 1.2$$

Otherwise, the control jumps to step 611.

At step 611, a final fuel injection amount TAU is calculated by $$TAU \leftarrow TAUP \cdot (1 + FWL + \alpha) + \beta$$

where $\alpha$ and $\beta$ are correction factors determined by other parameters such as the voltage of the battery and the temperature of the intake air. At step 612, the final fuel injection amount TAU is set in the down counter 108, and in addition, the flip-flop 109 is set to initiate the activation of the fuel injection valve 9. Then, this routine is completed by step 613. Note that, as explained above, when a time period corresponding to the amount TAU passes, the flip-flop 109 is reset by the carry-out signal of the down counter 108 to stop the activation of the fuel injection valve 9.

As explained above, since the warming-up fuel increment FWL is corrected by the coolant temperature at the moment when the starter is turned on, an overlean state of the air-fuel ratio is avoided even when the coolant temperature increases rapidly as compared with the temperature of the intake air. Particularly, when starting at an extremely low temperature, poor drivability and backfires are avoided.

Also, when a take-off operation is carried out during a warming-up mode, a further definite fuel increment is conventionally carried out regardless of the vehicle speed. If such a further definite fuel increment made is too large with the aim of improving the take-off drivability, the air-fuel ratio becomes on the rich side, thus inviting carbonization of spark plugs. Contrary to this, if such a further definite fuel increment is made too small with the aim of preventing carbonization of spark plugs, the air-fuel ratio becomes on the learn side, thus deteriorating the take-off drivability. According to the present invention, an initial stage of a take-off state is detected. The fuel increment is carried out only during such an initial stage. That is, as shown in FIGS. 8A to 8D, at time $t_1$, the vehicle speed SPD is zero and the output LL of the idling-position swtich 5 is "1". Therefore, before time $t_1$, the warming-up fuel increment FWL remains at a definite level. At time $t_1$ when a take-off operation is started, the engine speed Ne temporality increases and falls, and then again increases. However, before the vehicle speed SPD reaches 10 km/h, the warming-up fuel increment FWL is further increasesd. Then, at time $t_2$, when the vehicle speed SPD reaches 10 km/h, the warming-up fuel increment FWL is returned to the previous level before the time $t_1$. That is the warming-up fuel increment FWL is increased only during an initial stage from time $t_1$ to time $t_2$ of the take-off operation. As a result, carbonization of spark plugs is avoided simultaneously with improvement of the take-off drivability.

Figures 9A, 9B:
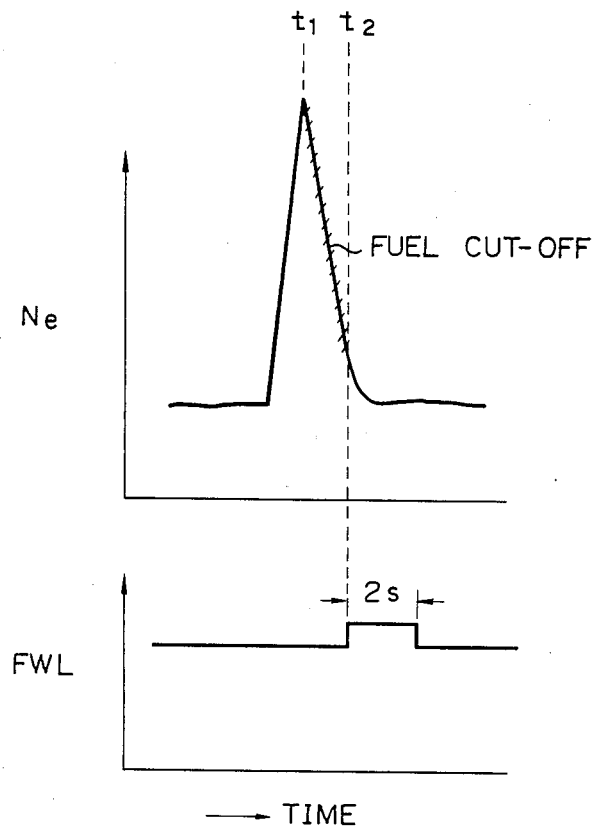
Figures 10A, 10B:
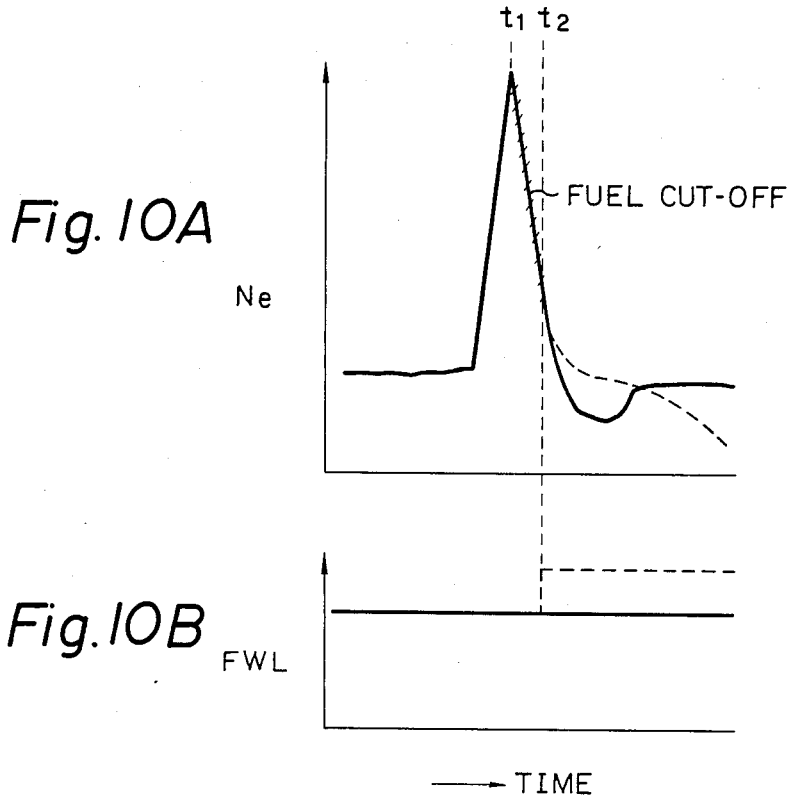

Further, when a transition from a fuel cut-off state to fuel cut-off recovery occurs during a warming-up mode, a large fuel increment is required as compared with a non-warming-up mode. However, if a definite large fuel increment continues, carbonization of spark plugs also may occur and an undershoot may be generated in the engine speed, thus causing engine stalling after racing. According to the present invention, when a transition from a fuel cut-off state to a fuel cut-off recovery state occurs after the throttle valve is completely closed, the warming-up fuel increment is further increased for a predetermined time period. That is, as shown in FIGS. 9A and 9B, at time $t_2$, when a fuel cut-off recovery state initiates after a fuel cut-off state ($t_1$ to $t_2$), the warming-up fuel increment FWL is further increased only for 2s, which prevents both engine stalling and carbonization of special plugs. Contrary to this, as shown in FIGS. 10A and 10B, if no further fuel increment is carried out after time $t_2$, the engine speed Ne greatly drops, as indicated by a solid line, which may cause engine stalling. Also, if a definite further fuel increment continues, the engine speed Ne hardly drops, as indicated by the dotted line, however, carbonization of spark plugs occurs, thus causing engine stalling.

We claim:

1. A method for controlling an air-fuel ratio in an internal combustion engine, comprising the steps of:

detecting a temperature of an engine coolant;

determining whether said engine is in a cranking state;

calculating a first fuel enrichment amount in accordance with the detected temperature of the engine coolant when said engine is in said cranking state;

storing said first enrichment amount;

calculating a second fuel enrichment amount in accordance with said temperature of said engine coolant when said engine is not in said cranking state;

calculating a third fuel enrichment amount in accordance with said first and second fuel enrichment amounts; and supplying fuel to said engine in accordance with said third enrichment amount.

2. An apparatus for controlling an air-fuel ratio in an internal combustion engine comprising the steps of:

means for detecting a temperature of an engine coolant;

means for determining whether said engine is in a cranking state;

processing means for:

(a) calculating a first fuel enrichment amount in accordance with the detected temperature of the engine coolant when said engine is in a cranking state, (b) storing said first enrichment amount;

(c) calculating a second fuel enrichment amount in accordance with the detected temperature of the engine coolant when said engine is not in a cranking state; and (d) calculating a third fuel enrichment amount in accordance with said first and second fuel enrichment amounts; and means for supplying fuel to said engine in accordance with said third enrichment amount.

3. A method for controlling an air-fuel ratio in an internal combustion engine, comprising the steps of:

detecting a temperature of an engine coolant;

determining whether said engine is in a cranking state;

calculating a fuel enrichment amount in accordance with the detected temperature of the engine coolant when said engine is in said cranking state and said temperature of said engine coolant when said engine is not in said cranking state; and supplying fuel to said engine in accordance wtih said enrichment amount.

4. An apparatus for controlling an air-fuel ratio in an internal combustion engine, comprising:

means for detecting a temperature of an engine coolant;

means for determining whether said engine is in a cranking state;

means for calculating a fuel enrichment amount in accordance with: (1) the detected temperature of the engine coolant when said engine is in said cranking state and (2) said temperature of said engine coolant when said engine is not in said cranking state; and means for supplying fuel to said engine in accordance with said enrichment amount.

5. A method for controlling the air-fuel ratio in an internal combustion engine, comprising the steps of:

detecting a temperature of an engine coolant;

detecting when a starter of the engine is turned on;

calculating a fuel enrichment amount in accordance with a currently detected temperature of the engine coolant and a temperature detected during a time when said starter is on; and incrementing fuel to be supplied to the engine by the fuel enrichment amount.

6. A method as set forth in claim 5, further comprising the steps of:

detecting a transition of the engine from a fuel cut-off state to a fuel cut-off recovery state;

measuring a duration period after the transition from the fuel cut-off state to the fuel cut-off recovery state;

determining whether the duration period is smaller than a predetermined period;

determining whether a throttle valve of the engine is completely closed; and increasing the fuel enrichment when the duration period is smaller than the predetermined period and the throttle valve is completely closed.

7. An apparatus for controlling the air-fuel ratio in an internal combustion engine, comprising:

means for detecting a temperature of an engine coolant;

means for detecting when a starter of the engine is turned on;

means for calculating a fuel enrichment amount in accordance with a currently detected temperature of the engine coolant and with a temperature of engine coolant detected when said starter is turned on; and means for incrementing fuel to be supplied to the engine by the fuel enrichment amount.

8. An apparatus as set forth in claim 7, further comprising:

means for detecting a transition of the engine from a fuel cut-off state to a fuel cut-off recovery state;

means for measuring a duration period after the transition from the fuel cut-off state to the fuel cut-off recovery state;

means for determining whether the duration period is smaller than a predetermined period;

means for determining whether a throttle valve of the engine is completely closed; and means for increasing the fuel enrichment when the duration period is smaller than the predetermined period and the throttle valve is completely closed.

9. A method for controlling the air-fuel ratio in an internal combustion engine, comprising the steps of:

detecting a temperature of an engine coolant;

determining whether a starter of the engine is on;

calculating fuel enrichment in accordance with a currently detected temperature of the engine coolant and with a temperature of the engine coolant when said starter is on;

incrementing fuel to be supplied to the engine by an amount proportional to the fuel enrichment;

determining whether a vehicle in which the engine is mounted is in an initial take-off; and increasing the fuel enrichment while the vehicle is in the initial take-off state.

10. A method as set forth in claim 9, wherein the initial take-off state determining step comprises the steps of:

determining whether the speed of the vehicle is smaller than a predetermined value;

determining whether a throttle valve of the engine is completely closed; and determining that the vehicle is in a take-off state when the speed of the vehicle is smaller than the predetermined value and the throttle valve is not completely closed.

11. A method as set forth in claim 9 wherein the initial take-off state determining step comprises the steps of:

determining whether the speed of the vehicle is smaller than a predetermined value;

determining whether a throttle valve of the engine is completely closed;

determining whether a gear-shift position of the transmission is at a drive (D) position when the transmission is an automatic transmission; and determining that the vehicle is in a take-off state when the speed of the vehicle is smaller than the predetermined value, the throttle valve is not completely closed, and the gear-shift position is at the drive position.

12. A method as set forth in claim 9, wherein the take-off state determining step comprises the steps of:

determining whether the speed of the vehicle is smaller than a predetermined value;

determining whether a throttle valve of the engine is completely closed;

determining whether a clutch of the transmission is depressed when the transmission is a manual transmission;

determining that the vehicle is in a take-off state when the speed of the vehicle is smaller than the predetermined value, the throttle valve is not completely closed, and the clutch is not depressed.

13. An apparatus for controlling the air-fuel ratio in an internal combustion engine, comprising:

means for detecting a temperature of an engine coolant;

means for determining whether a starter is on;

means for calculating fuel enrichment in accordance with a currently detected temperature of the engine coolant and with a temperature of the engine coolant when the starter is on;

means for incrementing fuel to be supplied to the engine by the fuel enrichment;

means for determining whether a vehicle in which the engine is mounted is in an initial take-off state; and means for increasing the fuel enrichment while the vehicle is in the initial take-off state.

14. An apparatus as set forth in claim 13, wherein the initial take-off state determining means comprises:

means for determining whether the speed of the vehicle is smaller than a predetermined value;

means for determining whether a throttle valve of the engine is completely closed; and means for determining if the vehicle is in a take-off state, the vehicle being determined to be in the take-off state when the speed of the vehicle is smaller than the predetermined value and the throttle valve is not completely closed.

15. An apparatus as set forth in claim 13, wherein said vehicle includes an automatic transmission, and wherein the initial take-off state determining means comprises:

means for determining whether the speed of the vehicle is smaller than a predetermined value;

means for determining whether a throttle valve of the engine is completely closed;

means for determining whether a gear-shift position of the automatic transmission is at a drive (D) position; and means for determining if the vehicle is in a take-off state, said vehicle being determined to be in the take-off state when the speed of the vehicle is smaller than the predetermined value, the throttle valve is not completely closed, and the gear-shift position is at the drive position.

16. An apparatus as set forth in claim 13, wherein said vehicle includes a manual transmission and wherein the take-off state determining means comprises:

means for determining whether the speed of the vehicle is smaller than a predetermined value;

means for determining whether a throttle valve of the engine is completely closed;

means for determining whether a clutch of the transmission is being depressed; and means for determining if the vehicle is in a take-off state, said vehicle determined in the take-off state when the speed of the vehicle is smaller than the predetermined value, the throttle valve is not completely closed, and the clutch is engaged.

* * * * *